US008347433B1

(12) United States Patent
Shih

(10) Patent No.: US 8,347,433 B1
(45) Date of Patent: Jan. 8, 2013

(54) ELECTRIC BED WITH USB RECEPTACLE

(75) Inventor: Chuan-Hang Shih, Changhua County (TW)

(73) Assignees: Ruoey Lung Enterprise Corp., Lu-Kang Township, Changhua County (TW); PPJ, LLC, Natick, MA (US)

( * ) Notice: Subject to any disclaimer, the term of this patent is extended or adjusted under 35 U.S.C. 154(b) by 0 days.

(21) Appl. No.: 13/343,960

(22) Filed: Jan. 5, 2012

(30) Foreign Application Priority Data

Oct. 28, 2011 (TW) ..... 100220288 U

(51) Int. Cl.
*A61G 7/002* (2006.01)

(52) U.S. Cl. ..... 5/613; 5/600

(58) Field of Classification Search ..... 5/613, 616, 5/600, 713, 708
See application file for complete search history.

(56) References Cited

U.S. PATENT DOCUMENTS 7,321,811 B1 * 1/2008 Rawls-Meehan ..... 700/302
2011/0247135 A1 * 10/2011 Herman et al. ..... 5/425

* cited by examiner

*Primary Examiner* — Fredrick Conley
(74) *Attorney, Agent, or Firm* — Muncy, Geissler, Olds & Lowe, PLLC

(57) ABSTRACT

An electric bed includes a bed frame, a power converter mounted with the bed frame for converting a 110V AC power to a 5V DC power, and a USB receptacle mounted to the bed frame and electrically connected with the power converter for transmitting the 5V DC power generated by the power converter. By this way, a user lying down on the electric bed can charge an electric device through the USB receptacle without leaving the electric bed, thereby enhancing the convenience of the user.

3 Claims, 3 Drawing Sheets

ELECTRIC BED WITH USB RECEPTACLE

BACKGROUND OF THE INVENTION

1. Field of the Invention

The present invention relates generally to an electric bed, and more specifically to an electric bed that includes a USB receptacle for charging.

2. Description of the Related Art

In order to enable a user lying down on the bed to get in a comfortable posture for reading or eating, an electric bed frame is generally used to adjust the tilt angle of the bed for changing the posture of the user. However, if the user needs to charge an electric device, such as a cell phone, through a USB interface, the user has to leave the bed and plug the electric device into the USB receptacle of the computer for charging. After the charging of the electric device is complete, the user needs to leave the bed again to unplug the electric device from the computer. Thus, it is inconvenient for the user to repeatedly get out of the bed for charging because the computer is usually located away from the bed.

SUMMARY OF THE INVENTION

The present invention has been accomplished in view of the above-noted circumstances. It is therefore one objective of the present invention to provide an electric bed, which has a USB receptacle for allowing a user to stay in the electric bed and charge an electric device.

To achieve this objective of the present invention, the electric bed comprises a bed frame having a base and a bracket pivotally connected with the base, a driver mounted with the base for driving the bracket to move relative to the base, a power converter mounted with the bed frame and having an AC input for connection of an external AC power source, and a first DC output for providing a DC power, and a USB receptacle mounted to the bed frame and electrically connected with the first DC output of the power converter for transmitting the DC power to an electric device. By this way, when lying down on the electric bed, a user can charge the electric device at any time without leaving the electric bed, thereby enhancing the convenience of the user.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
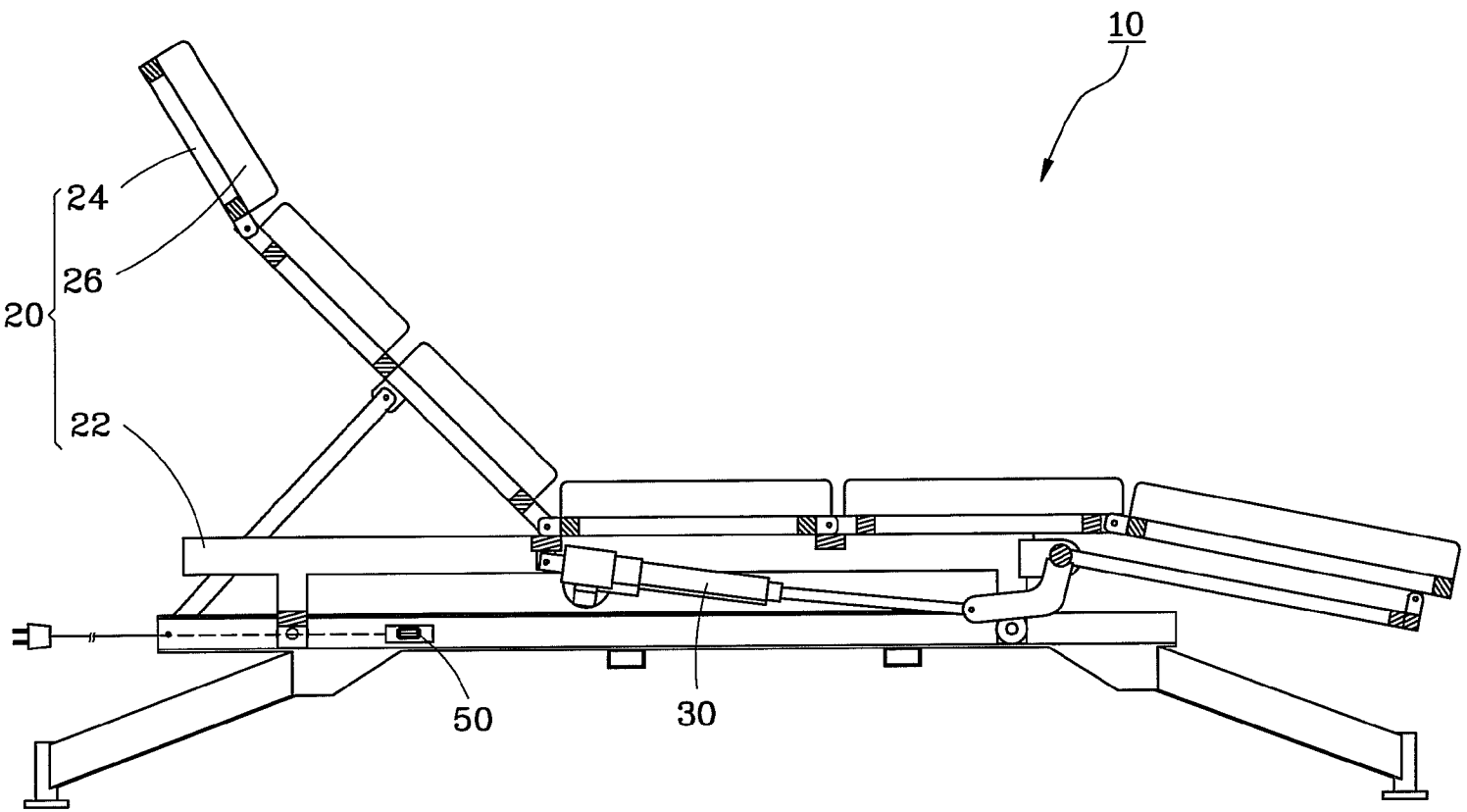
FIG. 1 is a schematic drawing of the electric bed according to a first embodiment of the present invention.
Figure 2:
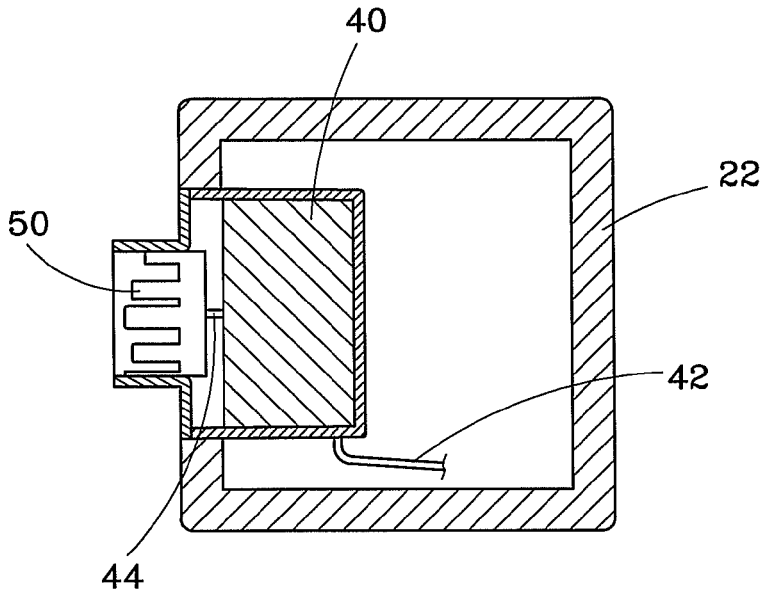
FIG. 2 is a partially sectional view of the electric bed according to the first embodiment of the present invention, showing the way of connection between the power converter and the USB receptacle.

As shown in FIGS. 1 and 2, an electric bed 10 in accordance with a first embodiment of the present invention comprises a bed frame 20, a driver 30, a power converter 40, and a USB receptacle 50.

The bed frame 20 includes a base 22, a plurality of brackets 24 mounted on the base 22 and pivotally connected with one another, and a plurality of cushions 26 disposed on the top sides of the brackets 24.

The driver 30 is mounted in the base 22 of the bed frame 20 for driving the brackets 24 to move to change the brackets' position or tilt angle relative to the base 22.

As shown in FIG. 2, the power converter 40 is mounted with the base 22 of the bed frame 20 and electrically connected with a 110V or 220V alternating current (AC) power source through an AC input 42, such that the 110V or 220V AC power generated by the AC power source can be converted to a 5V direct current (DC) power by the power converter 40, and then the 5V DC power can be provided by a first DC output 44 of the converter 40.

The USB receptacle 50 is mounted to the base 22 of the bed frame 20 in this embodiment and electrically connected with the first DC output 44 of the power converter 40 for transmitting the 5V DC power.

By means of the aforesaid design, when lying down on the electric bed 10 of the present invention, a user can adjust the bracket 24 of the bed frame 20 to a suitable angle for reading, eating or sleeping. If the user's electric device, such as a cell phone, needs to be charged through a USB interface, the user can stay in the electric bed 10 and plug the electric device into the USB receptacle 50 for charging. Once the charging of the electric device is complete, the user can unplug the electric device from the USB receptacle 50 without leaving the electric bed 10.

Figure 4:
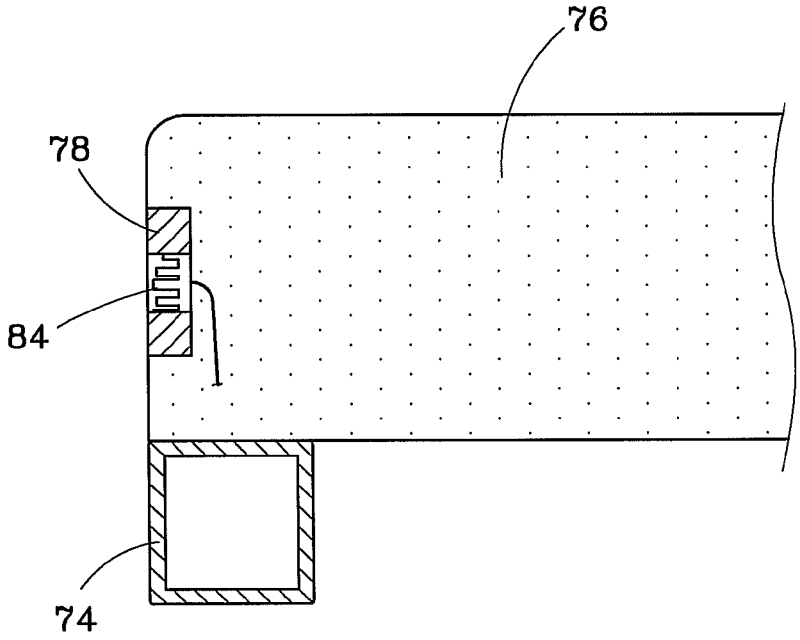
FIG. 4 is a sectional view taken along line 4-4 of FIG. 3.
Figure 3:
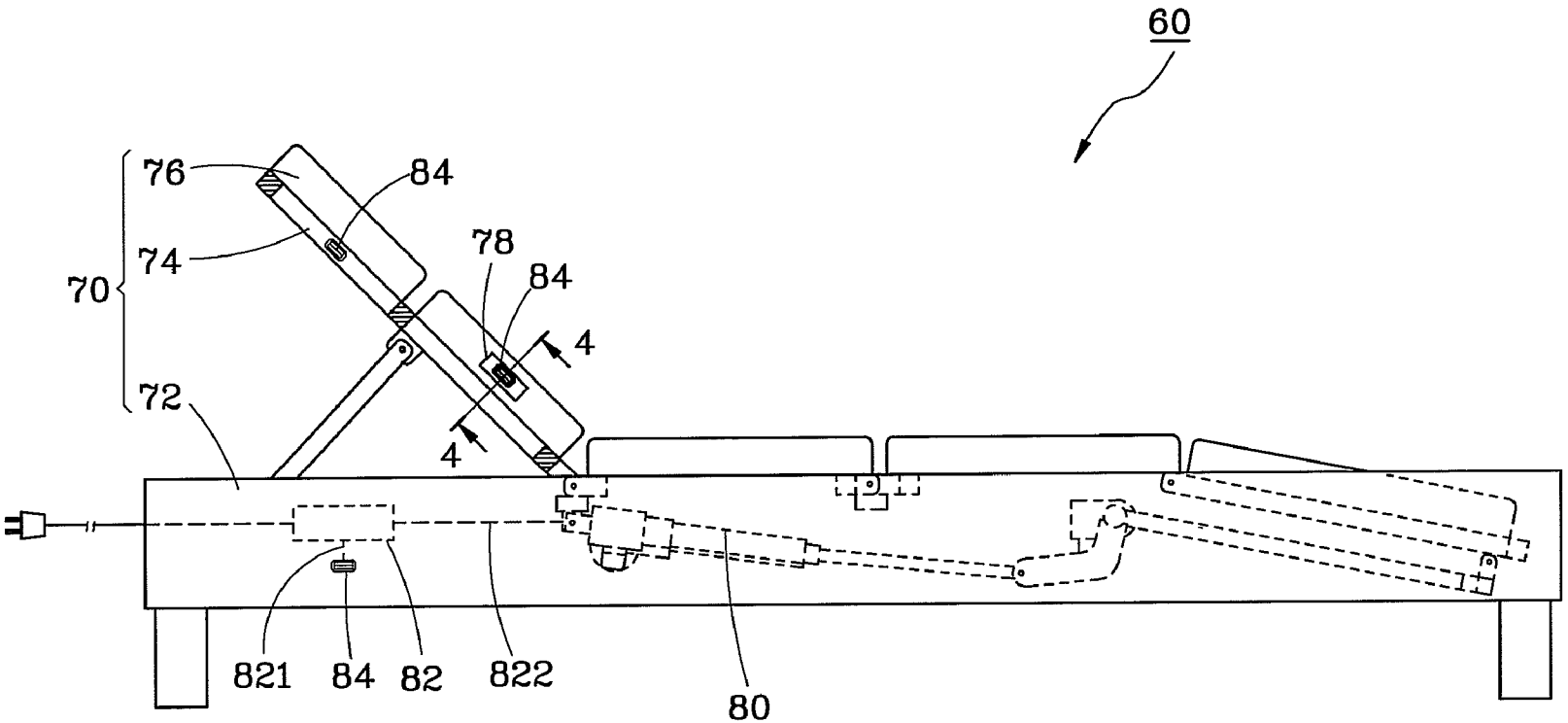
FIG. 3 is a schematic drawing of the electric bed according to a second embodiment of the present invention.

To deserve to be mentioned, the installation position of the USB receptacle can be changeable. FIG. 3 shows the electric bed 60 in accordance with a second embodiment of the present invention. In this embodiment, the base 72 of the bed frame 70 has a rectangular shape to cover the driver 80 or other mechanic devices. The power converter 82 is used to convert a 110V or 220V AC power to a 5V DC power and a 24V DC power. The power converter 82 is provided with a first DC output 821 electrically connected with the USB receptacle 84 and a second DC output 822 electrically connected with the driver 80. Therefore, the 5V DC power can be transmitted to the USB receptacle 84 through the first DC output 821, and the 24V DC power can be transmitted to the driver 80 through the second DC output 822. Besides, the USB receptacle 84 can be selectively installed in the lateral side of one of the brackets 74 of the bed frame 70, the lateral side of the base 72 of the bed frame 70, or a plate 78 mounted with the lateral side of one of the cushions 76 of the bed frame 70, as shown in FIGS. 3 and 4.

In the present invention, the USB receptacle can be mounted to the base, the bracket or the plate of the bed frame according to the actual needs for transmitting the 5V DC power generated by the power converter, so that the user lying down on the electric bed can charge the electric device at any time through the USB receptacle without getting out of the electric bed, thereby attaining the purpose of the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electric bed comprising:

a bed frame having a base and a bracket pivotally mounted on the base;

a driver mounted with the base for driving the bracket to move relative to the base;

a power converter mounted with the bed frame and having an AC input for electrically connecting with an external AC power source, and a first DC output for providing a DC power; and a USB receptacle mounted to the bed frame and electrically connected with the first DC output of the power converter;

the bed frame includes a cushion disposed on the bracket, and a plate mounted on a lateral side of the cushion for installation of the USB receptacle, the USB receptacle is exposed from the lateral side of the cushion.

2. The electric bed as claimed in claim 1, wherein the power converter has a second DC output electrically connected with the driver for providing a DC power.

3. The electric bed as claimed in claim 1, the plate mounted on a lateral side of the cushion for installation of the USB receptacle being flat.

* * * * *